United States Patent [19]

Eccleston et al.

[11] 4,454,818

[45] Jun. 19, 1984

[54] ADVANCING OF APPARATUS FOR REFURBISHING OVERHEAD STRUCTURES

[75] Inventors: Barry C. Eccleston, County Durham; Alexander S. Sinclair, Cheadle; Michael Elliot, County Durham, all of England

[73] Assignee: A. Monk and Company Limited, England

[21] Appl. No.: 311,817

[22] Filed: Oct. 16, 1981

[30] Foreign Application Priority Data

Oct. 18, 1980 [GB] United Kingdom ..... 8033682

[51] Int. Cl.[3] ..... B61F 13/00; B66C 9/02; E01B 26/00

[52] U.S. Cl. ..... 104/98; 104/107; 105/154; 182/37; 198/485; 212/209

[58] Field of Search ..... 104/89, 98, 107, 109, 104/111, 246, 93; 198/485; 212/122, 209; 105/148, 150, 154; 182/36, 37

[56] References Cited

U.S. PATENT DOCUMENTS

| | | | |
|---|---|---|---|
| 1,929,325 | 10/1933 | Masterson | 182/36 X |
| 2,416,352 | 2/1947 | Seward | 104/107 |
| 2,905,806 | 9/1959 | Tunney | 104/98 X |
| 2,925,240 | 2/1960 | Laviolette | 104/98 X |
| 3,468,264 | 9/1969 | Horompo | 104/98 |
| 4,201,275 | 5/1980 | Sinclair et al. | 182/37 |

FOREIGN PATENT DOCUMENTS

| | | | |
|---|---|---|---|
| 9569 | of 1911 | United Kingdom | 182/36 |

*Primary Examiner*—Robert B. Reeves
*Assistant Examiner*—Howard Beltran
*Attorney, Agent, or Firm*—William A. Drucker

[57] ABSTRACT

A coupling trolley is provided for a rail or runway beam that is longitudinally translatable relative to a member located above and extending transversely of the rail or runway beam. The trolley has rollers to engage and support the rail or runway beam via upper flanging thereof, and has first and second supporting engagers for the member, specifically lower flanging thereof. The trolley is movable with the rail or runway beam and relative thereto. When the trolley is stopped by its first engager reaching said member as the rail or runway beam is advanced with the trolley, the second engager of the trolley is movable by the end of the rail or runway beam, from non-engagement towards and into securing engagement with the member where it is held by cooperation with the upper surface of the rail or runway beam.

10 Claims, 6 Drawing Figures

ADVANCING OF APPARATUS FOR REFURBISHING OVERHEAD STRUCTURES

The invention relates to improvements in apparatus for refurbishing overhead structures and particularly concerns a coupling trolley for a translatable rail or runway beam.

We have made various previous proposals concerning such apparatus currently being commercially exploited under our Registered Trade Mark MONKRADLE. In principle, that apparatus comprises a working platform that is suspended from rails or runway beams themselves suspended in use normally from relatively transverse ribs or other frame members of the structure to be serviced. The suspensions both of the platform and of the rails or runway beams are by way of trolleys that permit movement of the platform along the rails or runway beams and axial movement of the rails or runway beams relative to the structure and the platform. In that way, a set of parallel rails or runway beams can be traversed by the platform during servicing of an overlying part of the structure, and then the rails or runway beams can be translated along their lengths relative to the platform, and progressively coupled to further ribs or frame members during such translation, so that the platform can be further translated along the rails or runway beams in order to service the next part of the structure.

A major advantage of our apparatus is that both of the rails or runway beams and the platform itself actually traverse the structure being serviced. Rail or runway beam coupling trolleys are removed from behind and secured in front as work progresses. Also, little or no encroachment is made on the space below the structure.

Hitherto, the translation of the rails or runway beams has, for their progressive coupling to ribs or other frame members, been accompanied by advance therewith or therealong of a lightweight man-carrying cradle from which rail or runway beam trolleys have been secured to the next rib or other frame member. It is an object of this invention to simplify this particular procedure, especially in overcoming the problems arising from the inevitable increase in deflection of the rails or runway beams attributable directly to the aforesaid cradles.

According to the present invention we propose a coupling trolley for a longitudinally translatable rail or runway beam with which and relative to which the trolley is movable, usually with rolling engagement therebetween, the trolley serving supportingly to engage the rail or runway beam and having attachment means to engage and be secured against falling from a member, usually flanged, located above and extending transversely of the rail or runway beam, which attachment means includes first and second parts supportingly to engage a said member from opposite sides that are nearest and furthest, respectively, in the direction of movement of the rail or runway beam, the second part being movable by the rail or runway beam from a position of non-engagement wherein it clears the said member to a position of securing engagement of the said member when the first part encounters the said member and stops the trolley from further movement with the rail or runway beam.

To this end, we have found it to be advantageous for the second part to pivot on the trolley about an axis transversely of the rail or runway beam and generally in the direction of said member. A suitable second part has two arms one having engagement means for said member and the other being engaged by an end of the rail or runway beam to pivot the one arm towards and into engagement with said member and wherein the one arm is then held by engagement of the other arm on an upper surface of the rail or runway beam. Usually, the two arms will be substantially at right angles and be pivotable together or separately on the same axis, advantageously an axis beyond the radial axis of the one arm so that said other arm will, even if separately pivoted fall out of its member engagement position except when held therein by its other arm on coaction with the upper surface of the rail or runway beam. In use, as an associated rail or runway beam is advanced, the coupling trolley hereof may simply have its said second part arms hang over the end of the rail or runway beam to move therewith until advance of the latter brings the said first part into engagement with the next said member whereupon the trolley will halt and the rail or runway beam pass therethrough bringing the said second part into its engagement position with said member.

The first and second parts will be configured to suit the portions of the said member that they are to engage. Where such portions are similar, say sides of a channel section or flanges of an I-beam, we prefer that both of the first and second parts of the trolley shall be of similar pivotted two-arm formation. Substantial advantage also arises if the free ends of the or each said other arm has a roller or wheel to run on upper flanging of the associated rail or runway beam, especially by way of rail or runway beam stability, where contact is beyond rollers or wheels of the trolley engaging under that upper flanging.

At least for a flanged said member, engagement by said first and second parts can permit relative movement, say by way of rollers or wheels on a lower flange, advantageously over a distance along the upper flange of the rail or runway beam to assist load spreading and stability. Also, of course, the position of the trolley on said member is then readily adjusted to level or position the platform and/or the rails or runway beams as desired whereupon clamping means for the last mentioned rollers or wheels can be operated.

One specific embodiment of the invention will now be described, by way of example, with reference to the accompanying drawings, in which.

Figure 1:
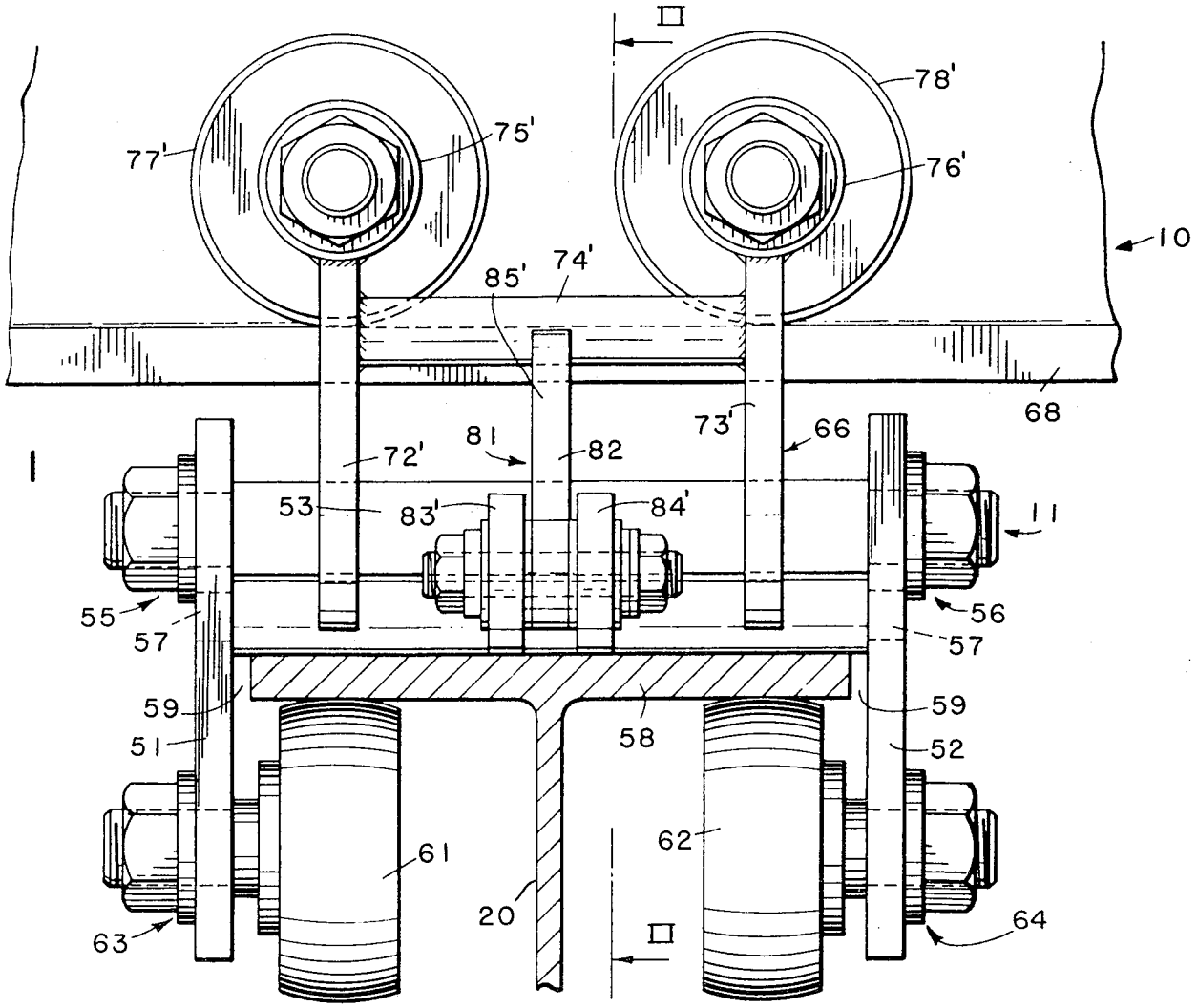
FIGS. 1 and 2 are end and cross-sectional (line II—II of FIG. 1) views of a coupling trolley for traversable rails or runway beams.
Figure 2:
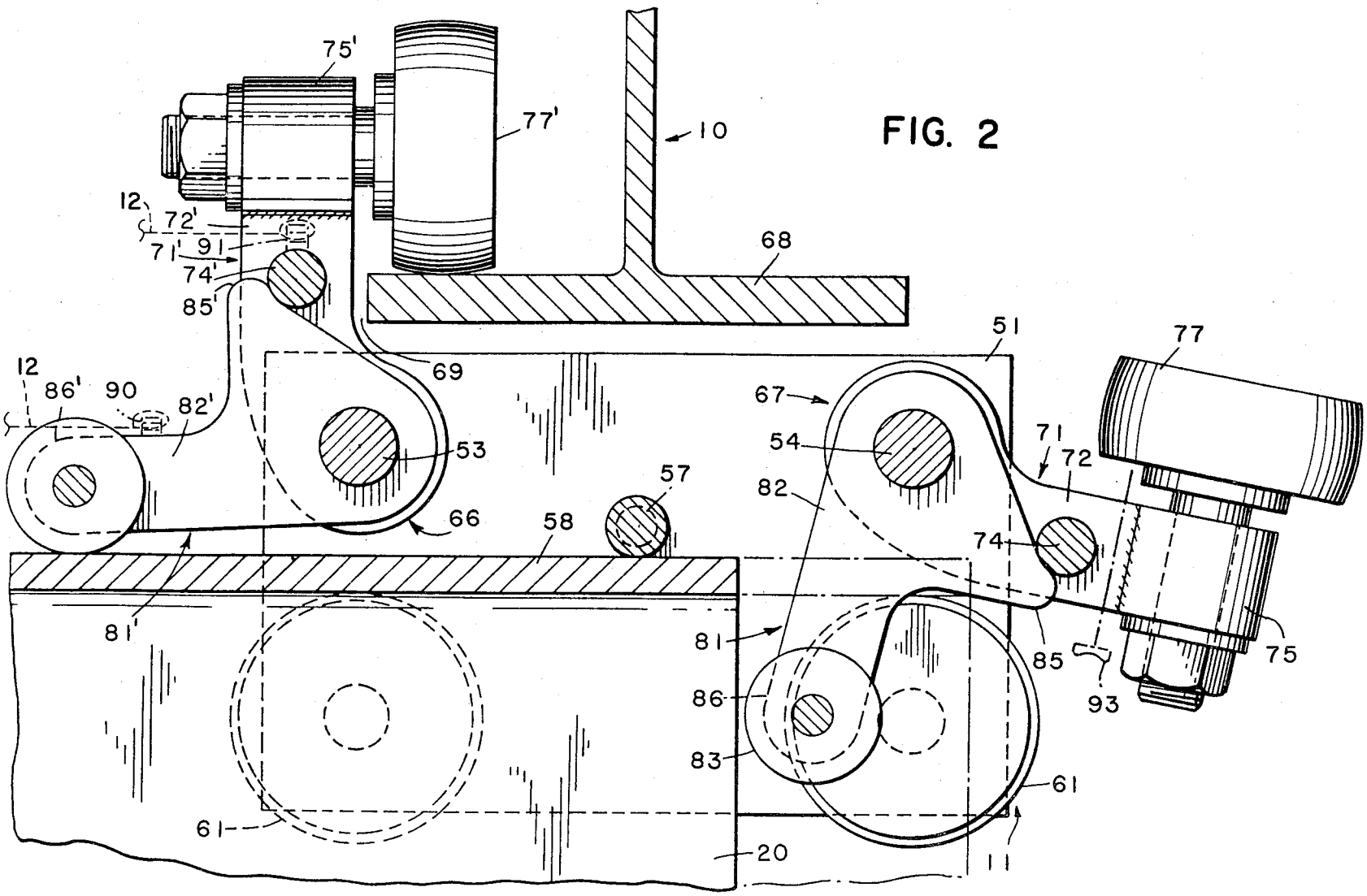

In the ensuing description made relative to depiction only of a single coupling trolley, it is to be understood that the overall operating system will include a working platform, which may be composite in the sense of having several different working levels or decks, see U.S. Pat. No. 4,201,275. The decks may, if desired, include separate sub-platforms of which lower ones will be partially suspended from a higher one and partially from the structure to be serviced. As a whole, whether composite or not, such a working platform will be suspended from rails or runway beams disposed in substantially parallel relation. An upper flange part only of one such rail or runway beam 20 is shown in FIGS. 1 and 2, but it will be one of a parallel set. That beam will actually be of I-section and its lower flange (not shown) will carry wheeled or rollered platform suspension trolleys capable of traversing therealong and permitting of the rail itself being moved through the platform suspension trolleys that normally rollingly engage that rail or runway at spaced positions on both sides of its lower flange for stability and load-spreading purposes. Extending downwards from the platform suspension trolleys will be suspenders connected thereto and to the platform itself. Flexible or suitably jointed suspenders, usually length-adjustable, will permit the platform effectively to follow a curve. Each of the rails or runway beams such as 20, will be of substantially greater length than the length dimension of the overall platform or subplatform it supports, usually the former unless shorter subplatforms are allowed to traverse independently of other subplatforms or a main platform from which they are suspended, then also using traversable rails or runway beams which can be considered, vis-a-vis the upper platform structure with which they are associated, as though the latter were the structure to be serviced.

In order for the rails or runway beams to traverse relative to the platform suspended therefrom, they are themselves coupled by trolleys making rolling engagement with upper flanging of the rails or runway beams and it is to one of these trolleys in particular that the drawings relate, particularly in facilitating movement of the rails or runway beams themselves. Suitable such coupling trolleys must, of course, be located securely against dropping off a support structure, usually the structure to be serviced. To this end, use is made of members secured to that support structure, and extending transversely of the rails or runway beams. Such members, one of which is shown at 10 in FIGS. 1 and 2, will afford a suitable purchase or mount for the coupling trolleys, as shown by a bottom flange. The main aim hereof is to secure efficient automatic latching of such trolleys to such members when the rails or runway beams are advanced in the direction of desired traverse of the structure to be serviced. That will be required when a span of that structure corresponding to the length of the rails or runway beams has been serviced during sequential traverse of those rails and runway beams by the platform. During such extension of the rails or runway beams, the platform itself will be suitable anchored either to the structure or to rails or runway beams that are then stationary, such rails or runway beams normally being advanced one at a time using a suitable winch means that can also serve in advancing the platform along the rails or runway beams.

In FIGS. 1 and 2, the coupling trolley 11 comprises a pair of side plates 51, 52 interconnected at their upper corners and spaced by two high tensile steels rods 53, 54 necked down and threaded at their ends where they pass through the plates 51, 52 for securement by nuts and washers such as 55, 56. A central end-necked and threaded rod interconnection of the side plates 51, 52 is also shown at 57 somewhat below the rods 53, 54.

The side plates 51, 52 span the upper flange 58 of traversable rail or runway beam with clearances 59 and each carry at their lower corners spaced pairs of wheels or rollers 61 and 62 suitably journalled and secured thereto at 63, 64. The wheels or rollers 61, 62 are to engage the underside of flange 58 as shown.

Freely pivotal on the rods 53, 54 are first and second parts 66, 67 that are generally similar but opposed as mirror images one of the other to be capable of spanning lower flange 68 of a member extending transversely of and above the rail or runway beam with clearances 69. We will now describe the second part 67 and primed references will be used to identify generally similar components of the first part 66.

The second part 67 has a first arm arrangement 71 that actually comprises two spaced end-pivotted arms 72, 73 interconnected by a high tensile rod 74 welded thereto and each carrying a bush 75 welded thereto and rotatably carrying rollers or wheels 77 to run on upper surfaces of lower flange 68 of the transverse member. A second arm arrangement 81 comprises a cam plate 82 pivotted at a central position between the arms 72, 73 and carrying at one end a pair of rollers or wheels 83 suitable journalled thereto one on each side of the cam plate 82. A cam nose 85 is shown to engage the rod 74 interconnecting arms 72. At such engagement, the first arm arrangement 71 has its arms 72 substantially at right angles to the wheel or roller carrying extension 86 of the cam plate 82.

In use to achieve automatic coupling action, the trolley of FIGS. 1 and 2 is engaged at the end of rail or runway beam with the second coupling part 67 and its underlying wheel or roller (61, 62) off the end of the rail or runway beam as shown in FIG. 2. Then, offsetting of the pivot axes inboard of the first arm arrangements 71, 71' ensures that the whole of the second part 67 will rotate clockwise at least to the position shown where it cannot foul the transverse member flange 68, and that the first part 66 will rest with rollers or wheels 83', 84' on the upper flange 58 of the extendable rail or runway beam and the connection rod 74' of its first arm arrangement on the cam plate nose 85' when the rod 57 is also in contact with the upper flange 58.

When the rail or runway beam thus equipped is extended, the second part 67 of the trolley coupling will pass under the next transverse member, and the first coupling part 66 will have its wheels or rollers 71', 78' engage over the flange 68. The trolley coupling will be halted but the rail or runway beam will continue to advance so that its end engages arm 81 and raises that and wheels 77 upwards by counterclockwise rotation on FIG. 2 until those wheels engage on the opposite part of flange 68 and the wheels or rollers 83, 84 run on the upper flange 58 of the rail or runway beam. At that stage, there may be a slight clearance between flange 58 and the rod 57, though the latter could be wheeled or rollered if preferred to afford the trolley, three spaced rolling contacts with the upper surface of the flange 58 with intervening rolling contacts at its bottom surface, rather than simply with two rolling contacts trailing and leading two spaced bottom rolling contacts.

Security against the trolley falling off the end of the rail or runway beam can be afforded by a cord 12 running from a connection ear such as 90 to the cam plate 82' or 91 to the connection rod 74'. Alternatively, the second arm arrangement 81 may have two spaced cam plates straddling the central web thickness of the rail or runway beam, even one cam plate off-set therefrom, the end of such rail or beam being without top flanging 58 for a sufficient distance to a cam plate retaining peg or pegs to allow upward swinging of the second part 67 as a whole once the trolley is halted by its first part 66 and the rail or beam runs therethrough.

The wheels or rollers 77 and 77', 78' obviously permit of translation along the flange 68. Suitable brakes, clamps or latches may be provided to prevent that once the desired trolley position is achieved. A simple wing-ended clamping bolt is indicated at 93 in FIG. 2, though action could alternatively be through the bush 75 or via tightening of the nutted connection to that bush.

Figure 3:
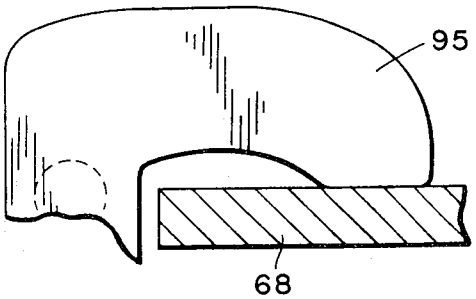
FIGS. 3 and 4 show coupling trolley or rail modifications.

If rolling contact with the flange 68 is not desired, say for an arched structure to be serviced, the wheels or rollers 77 may be omitted in favour of claw-ends such as 95 for the arms 72, 73, see 95 in FIG. 3. There, engagement on a flange is assumed for the claw-end 95, but it could equally well be configured to engage over an upstanding web, for example of an angle member affording a flange at its other side.

Figure 4:
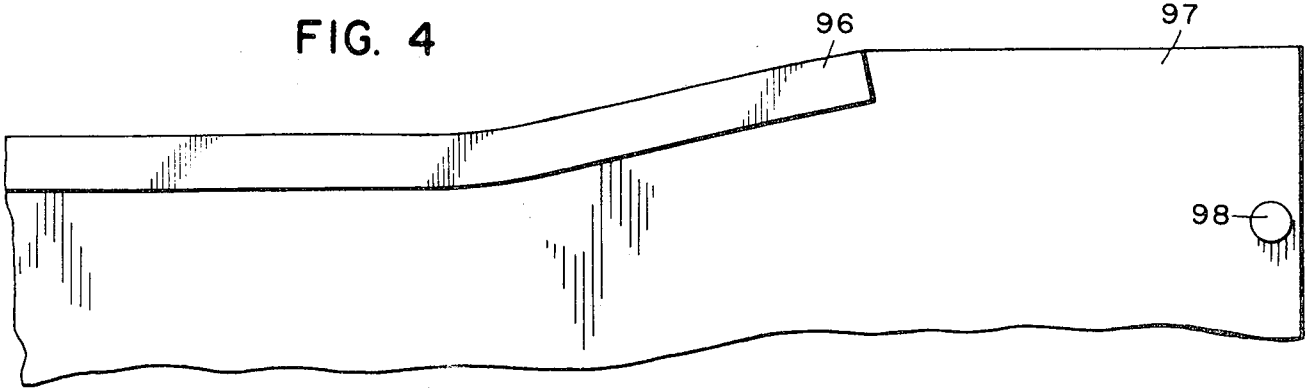

Any problems arising from downward deflection of a rail or runway beam as it is extended equipped with the automatic trolley hereof may be overcome by modification to the rail or runway beam. Thus, either an end section of a length up to about the span between transverse members may be canted slightly upwardly or, and perhaps preferably, the end up to about the length of the trolley may be 'sledged' more steeply, i.e. have its upper flange shaped upwards, see 96 in FIG. 4 which also shows an end part 97 unflanged at its top and fitted with a coupling trolley retainer peg 98 as mentioned above for a double or offset complete type trolley.

Figure 5:
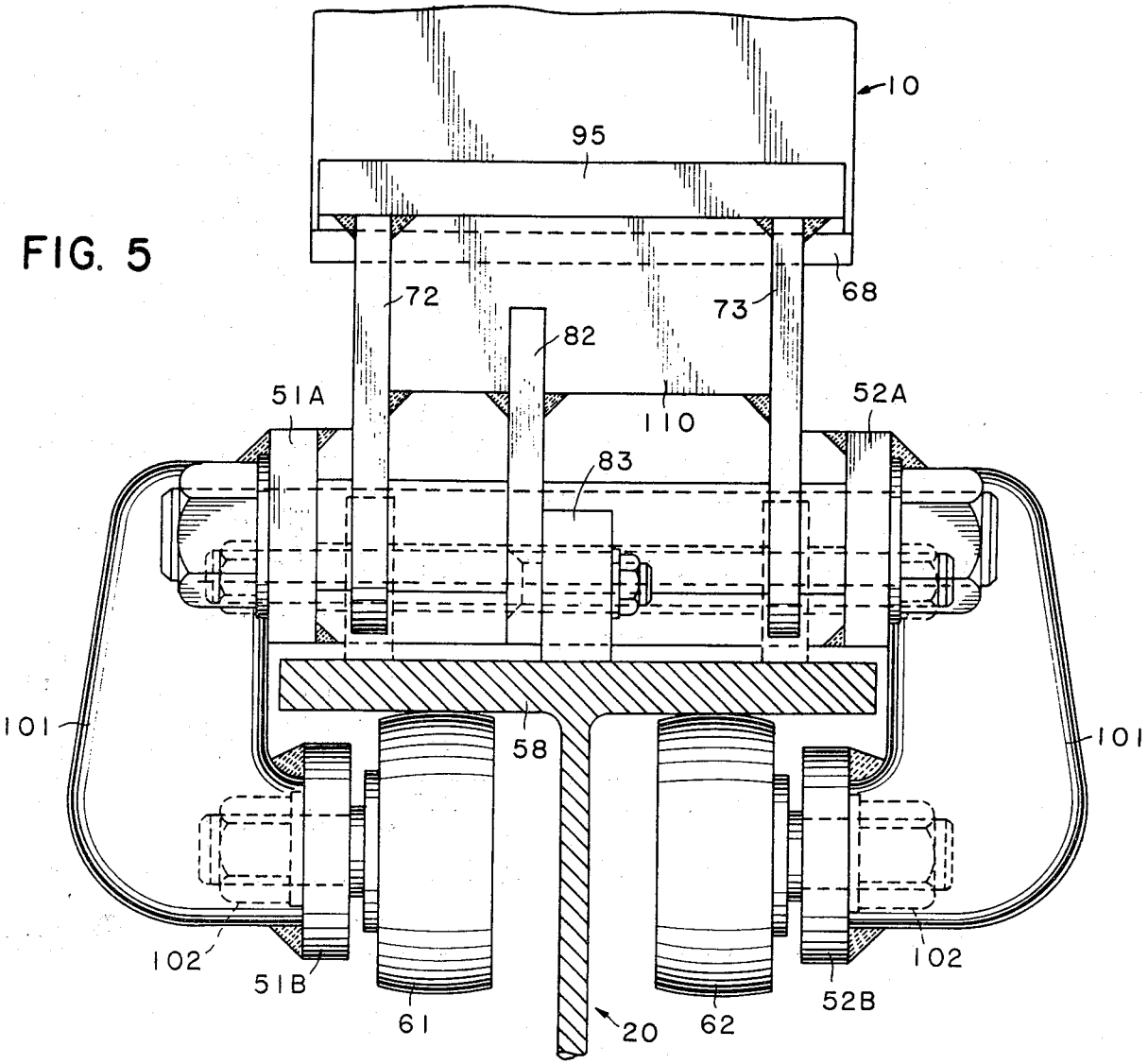
FIGS. 5 and 6 show another coupling trolley in views similar to FIGS. 1 and 2.
Figure 6:
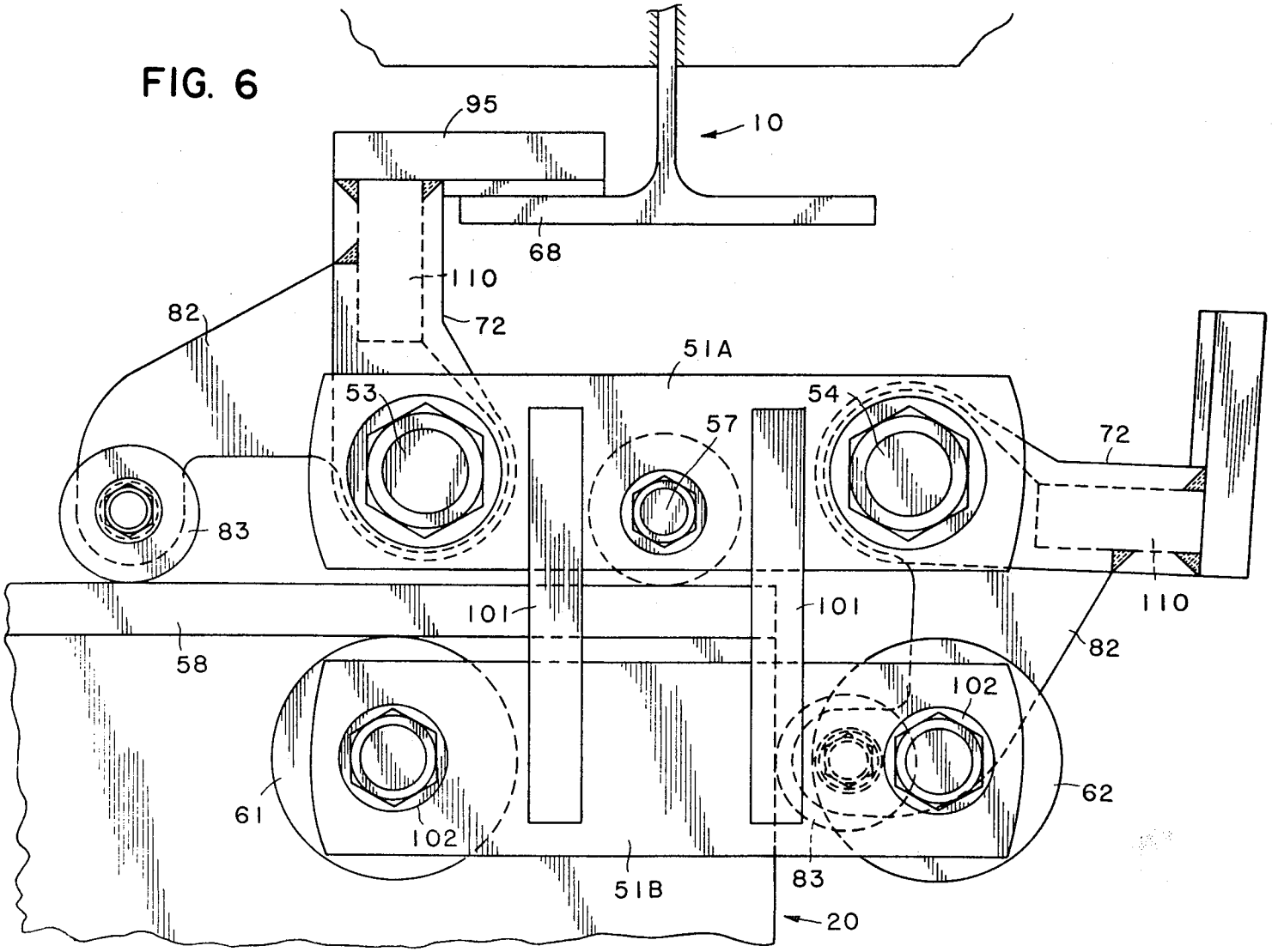

The side plates 51, 52 may each be replaced by spaced upper and lower plates see 51A, 51B and 52A, 52B in FIGS. 5 and 6 connected together by stiffeners, say as plates (101) edge welded to both of sets of upper and lower plates so that the stiffener plates extend away at right angles.

The lower plates 51B, 52B then carry bearings 102 for the wheels or rollers 61, 62 and the upper plates 51A, 51B carry the rods 55, 57 in appropriate bearings. Overall, such a frame structure will be stiff and load-resistant in every direction, bearings being indicated for all pivotable parts.

The arm 82 carrying wheels or roller 83 may be relative to a connection (see FIGS. 3 and 4) of arms 72, say welded medially to a stiffener plate (110) end-welded to the arms 72. The result is effectively one-piece upper flange engagers, whether or not they carry wheels or rollers 76, 77 or are simply clawed or end flanged (see FIGS. 5 and 6) to engage over upper flanges. Those parts are counterweighted by their arms 82 to come free of the upper beam flanges except when the wheels or rollers 86 run on runway rails or beams 58.

We claim:

1. A coupling trolley for a beam that is longitudinally translatable relative to a flanged member located above and extending transversely of the beam, the trolley serving supportingly to engage said beam and to be movable with and relative to said beam, the trolley further having attachment means supportingly to engage said flanged member, the attachment means including first and second parts to engage said flanged member from opposite sides that are nearest and furthest, respectively, in the direction of movement of said beam, the second part being movable by shifting said beam to cause the second part to move from a retracted position wherein it clears said flanged member to a position of securing-engagement of said flanged member when the first part encounters the said flanged member and stops the trolley from further movement with said beam.

2. A coupling trolley as claimed in claim 1, wherein at least the second part is pivoted to the trolley on an axis transversely of said beam and generally in the direction of said flanged member.

3. A coupling trolley as claimed in claim 2, wherein the second part has two cooperating arms, one having engagement means for said flanged member and the other being engageable by an end of said beam to pivot the one arm toward and into engagement with said flanged member wherein the one arm is then held by engagement of the other arm on an upper surface of said beam.

4. A coupling trolley as claimed in claim 3, wherein the two arms are fixed relative to each other substantially at right angles.

5. A coupling trolley as claimed in claim 3, wherein the two arms are separately pivoted at said axis with abutments therebetween by which the one arm moves and holds the other arm when itself moved and engaged by said beam.

6. A coupling trolley as claimed in claim 3, wherein the first and second parts are similar.

7. A coupling trolley as claimed in claim 3, wherein securing engagement of said flanged member is over a distance greater than the width of the trolley.

8. A coupling trolley as claimed in claim 3, wherein securing engagement of said flanged member is by way of rolling contact means relative to the upper side of said lower flanged surface of said flanged member.

9. A coupling trolley as claimed in claim 3, wherein the other arm has rolling engagement means for said upper surface of said beam.

10. A coupling trolley according to claim 9, wherein the trolley has means for making rolling contact with the undersides of the upper flanged surface of said beam and the rolling engagement means of the other arm is beyond that for the undersides of said upper flanged surface.

* * * * *